US005326268A

United States Patent [19]

Campagnuolo

[11] Patent Number: 5,326,268

[45] Date of Patent: Jul. 5, 1994

[54] TRAINING DEVICE FOR SIMULATING AN UNEXPLODED SUBMUNITION

[75] Inventor: Carl Campagnuolo, Potomac, Md.

[73] Assignee: The United States of America as represented by the Secretary of the Army, Washington, D.C.

[21] Appl. No.: 5,695

[22] Filed: Jan. 19, 1993

[51] Int. Cl.[5] ..... G09B 19/00; F41A 33/00

[52] U.S. Cl. ..... 434/15; 434/11; 434/14

[58] Field of Search ..... 434/11, 12, 14, 15, 434/16

[56] References Cited

U.S. PATENT DOCUMENTS

| | | | |
|---|---|---|---|
| 3,369,486 | 2/1968 | Wrennstad et al. . | |
| 3,878,639 | 4/1975 | Scheelar et al. | 434/11 X |
| 3,941,058 | 3/1976 | Gawlick et al. | 102/70.2 |
| 4,319,426 | 3/1982 | Lee | 46/200 |
| 4,461,117 | 7/1984 | Gott | 446/473 |
| 5,074,793 | 12/1991 | Hambric et al. | 434/11 |
| 5,199,874 | 4/1993 | Campagnolo et al. | 434/11 |
| 5,207,579 | 5/1993 | Campagnolo | 434/11 |

*Primary Examiner*—Gene Mancene
*Assistant Examiner*—Cindy A. Cherichetti
*Attorney, Agent, or Firm*—Frank J. Dynda; Jason Shapiro

[57] ABSTRACT

An acoustic training device for simulating the effects of an unexploded submunition in a tactical engagement simulation system generates an audible signal of a predetermined frequency and duration when handled or otherwise disturbed. A timing circuit allows the referee to place the armed device in the playing field without activating the audible signal. Exemplary submunitions include the M118 Rockeye with an integral horn, the blue series of spherical bomblets, and the M42/46 grenade submunition.

4 Claims, 9 Drawing Sheets

TRAINING DEVICE FOR SIMULATING AN UNEXPLODED SUBMUNITION

GOVERNMENTAL INTEREST

The invention described herein may be manufactured, used and licensed by or for the U.S. Government for governmental purposes without the payment to me of any royalties thereon.

BACKGROUND OF THE INVENTION

The present invention relates generally to Multiple Integrated Laser Engagement System (MILES) type training devices, and more particularly to an acoustic training device for simulating the effects of unexploded submunitions in a tactical engagement simulation system such as the MILES.

"Submunition" are weapons that are delivered en masse by being packaged in containers that comprise a weapon system. For example: cluster bombs contain many small bomblets (submunitions) which are clustered together and delivered simultaneously. Once dispersed a submunition becomes an individual, independent, and lethal weapon system. Similarly, a dispersed submunition simulator becomes an independent weapon simulator.

The MILES has revolutionized the way in which armies train for combat. MILES has been fielded with armies of many nations around the world and has become the international standard against which all other Tactical Engagement Simulation (TES) systems are measured. For the U.S. Army and Marine Corps, MILES is the keystone of their opposing force, free-play TES program. It is highly valued in its ability to accurately assess battle outcomes and to teach soldiers the skills required to survive in combat and destroy the enemy. With MILES, commanders at all levels can conduct opposing force free-play tactical engagement simulation training exercises which duplicate the lethality and stress of actual combat.

The MILES system uses laser "bullets" to simulate realistically the lethality of a modern battlefield. Eye-safe Gallium Arsenide (GaAs) laser transmitters, capable of shooting pulses of coded infrared energy, simulate the effects of live ammunition. The transmitters are easily attached to and removed from all hand-carried and vehicle-mounted direct-fire weapons. Detectors located on opposing troops and vehicles receive coded laser pulses. MILES decoders then determine whether the target was hit by a weapon which could cause damage (hierarchy of weapons effects) and whether the laser bullet was accurate enough to cause a casualty. The target vehicle or troops are made instantly aware of the accuracy of the shot by means of audio alarms and visual displays, which can indicate either a hit or a near miss.

The codeed infrared energy is received by silicon detectors located on the target. In the case of ground troops, the detectors are installed on webbing material which resembles the standard-issue load-carrying lift harness. Additional detectors are attached to a web band which fits on standard-issue helmets. For vehicles, the detectors are mounted on belts which easily attach to the front, rear, and sides. The detectors provide 360° azimuthal coverage and sufficient elevation coverage to receive the infrared energy during an air attack. The arriving pulses are sensed by detectors, amplified, and then compared to a threshold level. If the pulses exceed the threshold, a single bit is registered in the detection logic. Once a proper arrangement of bits exists, corresponding to a valid code for a particular weapon, the decoder decides whether the code is a near miss or a hit. If a hit is registered, a hierarchy decision is made to determine if this type of weapon can cause a kill against this type of target and, if so, what the probability of the "kill" might be.

While great success has been enjoyed with weapons that can be aimed, there has been no convenient or economic way for the military to incorporate grenades, mines, submunitions and other omnidirectional weaponry into their tactical exercises using the MILES. Grenades, for instance, tend to rotate during flight and would require a plurality of laser emitters to simulate a burst. Even were it economical to provide several laser emitters on each grenade, there is still the possibility that a player may be obstructed from view and thus unrealistically protected. Similarly, unexploded submunitions may be laying in tall grass or under a rock when disturbed, effectively attenuating any possible visual signal.

Copending patent application Ser. No. 07/691,603, entitled "Apparatus and Method for Interfacing Indirect-Fire Devices with MILES," uses a predetermined acoustic signal to simulate an explosion in combination with receiver circuitry sensitive to the acoustic signal and operatively connected to the existing MILES power supply. A special feature presently incorporated in the MILES provides for an audible alarm to be activated upon removal and reinsertion of the MILES power source. This feature prevents someone from cheating by deactivating his MILES receiver during simulated combat. When the power source (typically a battery) is reinstalled an audible alarm is sounded. Consequently, by momentarily removing the MILES power source from the circuit for a brief instant and then reconnecting it back into the circuit the interfacing device is able to indicate a "kill" on MILES. This operation is performed when receiver circuitry detects a predetermined acoustic signal of sufficient amplitude and duration or can even be a coded acoustic signal. An acoustic signal overcomes the disadvantages of highly directional laser pulses because of its substantially omnidirectional propagation characteristics.

Training devices which generate a predetermined acoustic signal of sufficient amplitude and duration and/or coded acoustic signals are described in copending patent application Ser. No. 07/983,952, entitled "Acoustic Training Device for Use in a Tactical Engagement System." Particular training devices which simulate a grenade, a "Bouncing Betty," and a Claymore mine are also described in copending patent applications Ser. Nos. 07/608,923, 07/708,253 and 08/002,367, respectively. All of these training devices are designed to accurately simulate the effects of a properly functioning weapon in a tactical engagement simulation.

The present invention, on the other hand, is intended to simulate the effects of a weapon which has failed to operate after deployment. Many of the submunitions and M42/M46-type grenades now in use require a mechanical firing pin to impact a stab detonator in order to initiate the explosives found in these devices. It has been demonstrated that a firing system relying on a firing pin to strike a stab detonator is not sensitive to impact angles significantly less than 90° with respect to the target.

Consequently, the battlefield can become littered with armed submunitions that can then be triggered upon contact by vehicles or personnel walking through the battlefield.

An example of such a mechanical submunition firing system is exhibited in the Army M223 fuze, which is employed in M42/M46 submunition grenades. These grenades, described in U.S. Pat. No. 4,852,496, to Campagnuolo, are stacked atop one another and are delivered either by artillery projectile or rocket cargo rounds.

In addition to the M42/M46 grenades, there exists a host of other submunitions used by the Navy, Air Force and Marines. Some of these include the M118 Rockeye submunition grenade which is launched by aircraft, and the blue series of submunition grenade which are spherical bomblets also delivered by aircraft.

If any of these submunition grenades do not function after release, either from aircraft, bomb, rocket or artillery projectile, they will lie upon the ground and remain live. Any disturbance will then cause them to explode. The disturbance can occur whenever a vehicle drives over the submunition, or even when a soldier or civilian picks one up out of curiosity or in an attempt to recover souvenirs. This can be particularly troublesome in a desert environment where the relatively soft impact afforded by the sand results in a significant number of "duds."

SUMMARY OF THE INVENTION

Accordingly, it is an object of the present invention to provide an acoustic training device which simulates the effects of an unexploded submunition in a tactical engagement simulation system.

It is another object of the present invention to provide an acoustic training device which simulates the effects of an unexploded submunition in a tactical engagement simulation system without requiring airborne or artillery delivery.

It is still another object of the present invention to provide an acoustic training device which simulates the effects of an unexploded submunition in a tactical engagement simulation system after placement in the field by a referee.

It is yet another object of the present invention to provide an acoustic training device which resembles in appearance certain submunitions but fails to operate immediately pursuant to conventional delivery in a tactical engagement simulation system.

These objects and others not specifically enumerated are accomplished with a an acoustic training device which resembles a submunition in appearance but houses sound generating means, a motion sensor, activation and delay circuitry. The sound generating means include a buzzer which emits an audible signal of a predetermined frequency and duration which is easily recognized by an audio-equipped tactical engagement simulation system receiving unit. In order that the submunition training device may be properly positioned in the battlefield, it is equipped with a delay circuit which, after arming, delays activation of the motion sensor. After the time delay, any physical disturbance will complete the circuit causing the buzzer to sound. In one embodiment the timing means comprises an R-C circuit and comparator which outputs a signal voltage upon charging of the capacitor during a period related to the time constant of the circuit. Three types of submunition grenades are also described to better illustrate how the invention is practiced and to represent those submunitions which are delivered by airplane, artillery or rocket. The present invention is, however, also intended to encompass other types of weapons which are in real combat delivered in these ways but which fail to detonate.

BRIEF DESCRIPTION OF THE DRAWINGS

The preferred embodiments of the present invention will be described with reference to the accompanying drawings in which.

Figure 8:
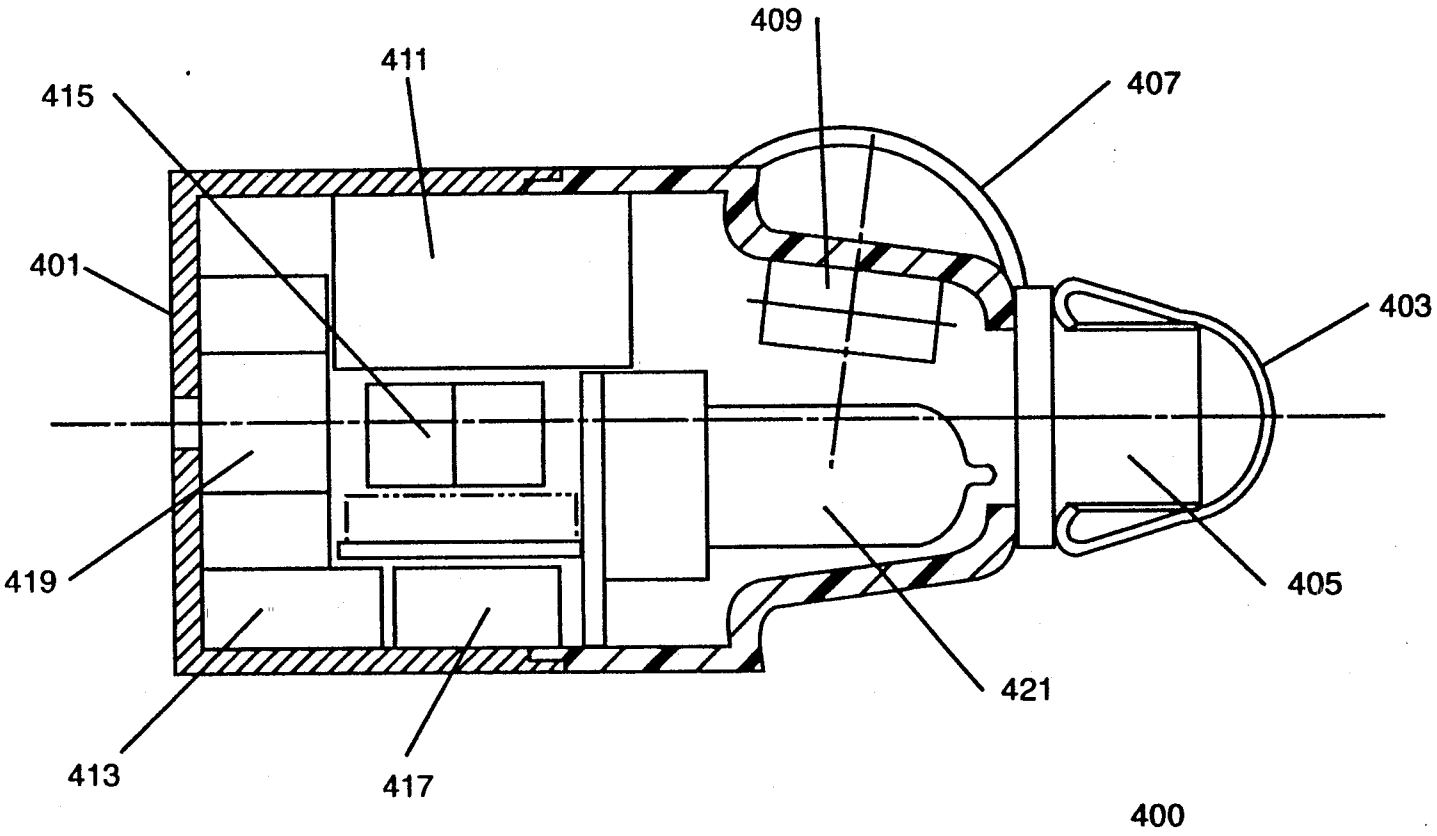

FIG. *7a* is a cross-sectional view of a blue series submunition training device according to the present invention;

FIG. *7b* is a cross-sectional view taken along line *7b*—*7b* of FIG. *7a*;

FIG. 8 is a cross-sectional view of the M42/M46 submunition training device according to the present invention;

FIG. *9a* is a mechanical motion switch such as that employed in one embodiment of the present invention;

and FIG. *9b* is a multi-directional mercury switch such as that employed in one embodiment of the present invention.

DESCRIPTION OF THE PREFERRED EMBODIMENTS

Figure 1:
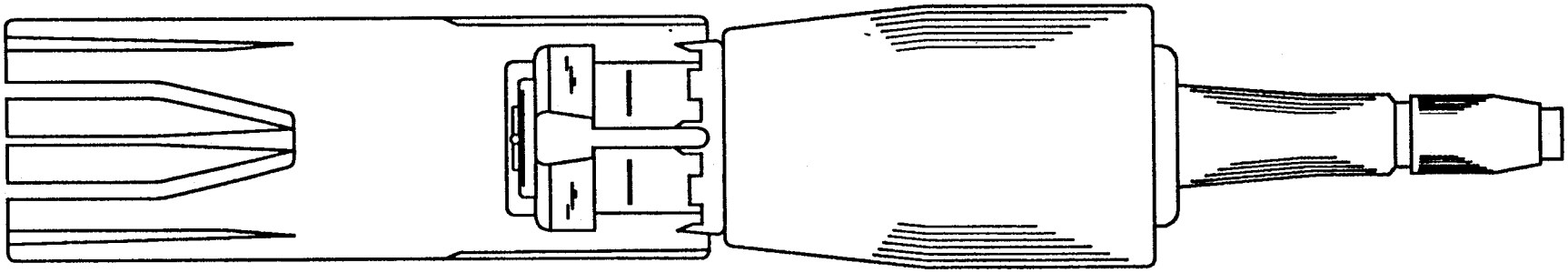
PRIOR ART FIG.1
FIG. 1 is a side view of a prior art M118 Rockeye submunition grenade which is typically delivered by artillery round.
Figure 2:
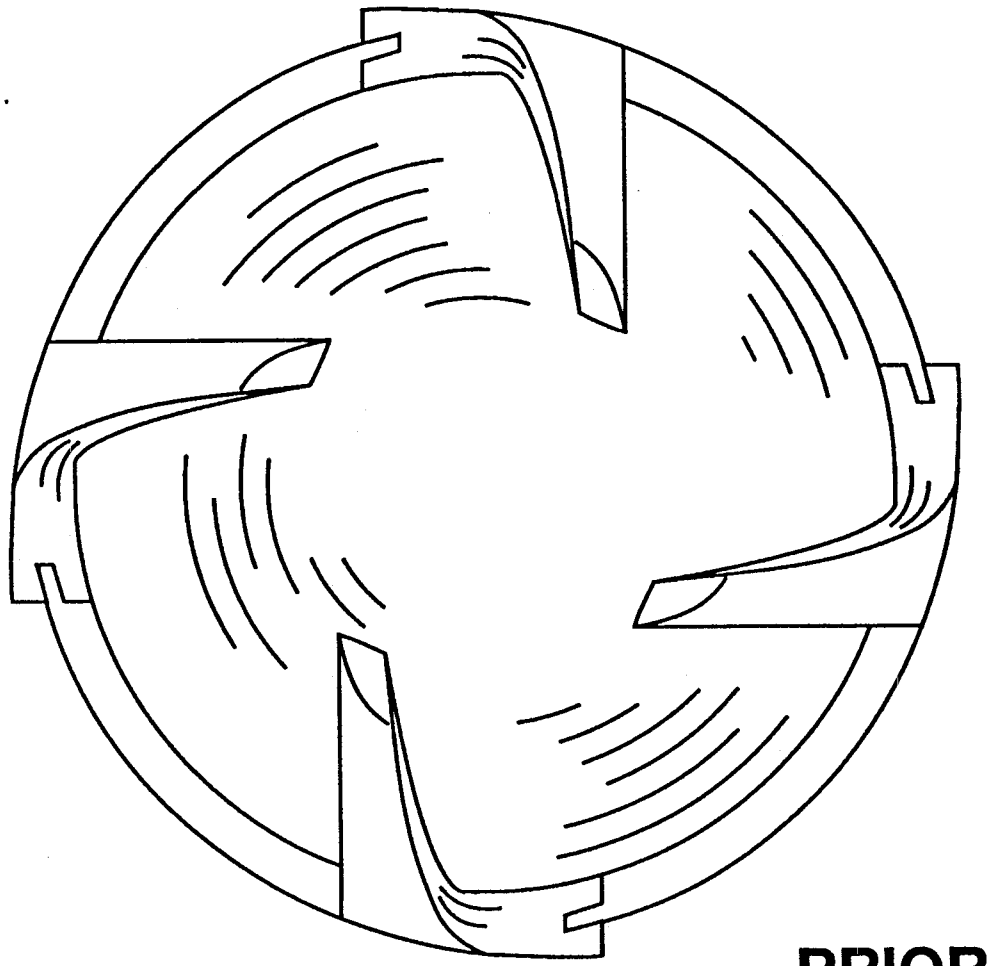
PRIOR ART FIG.2
FIG. 2 is a side view of a prior art blue series, air-delivered spherical bomblet.
Figure 3:
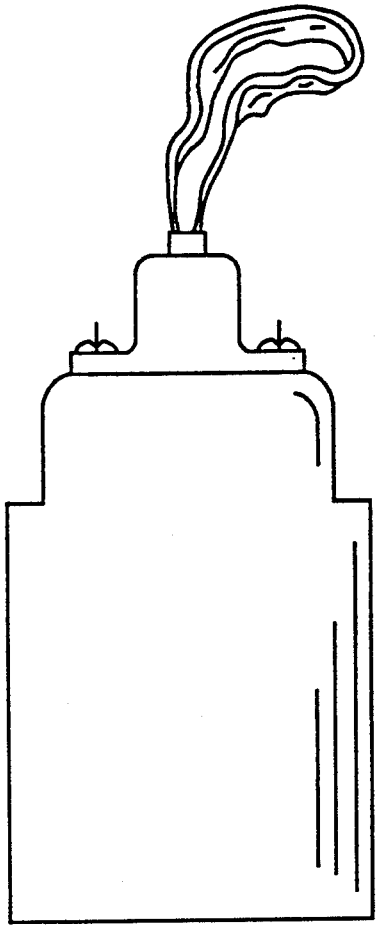
PRIOR ART FIG.3
FIG. 3 is a side view of a prior art M42/M46 air-delivered submunition grenade.

Conventional prior art submunitions such as those shown in FIGS. 1, 2 and 3 vary in appearance according to way in which they are deployed and the type of target they are intended to be used against. A common feature among submunitions is that they are all delivered en masse to the target from a remote position, either by aircraft, artillery shell or rocket. Submunitions can be used to destroy an opponents airport runways or as antipersonnel devices. The M118 Rockeye submunition grenade depicted in FIG. 1, and the blue series of spherical bomblets shown in FIG. 2 are delivered by air. The M42/M46 grenade submunition shown in FIG. 3 is typically delivered by artillery shell.

Figure 4:
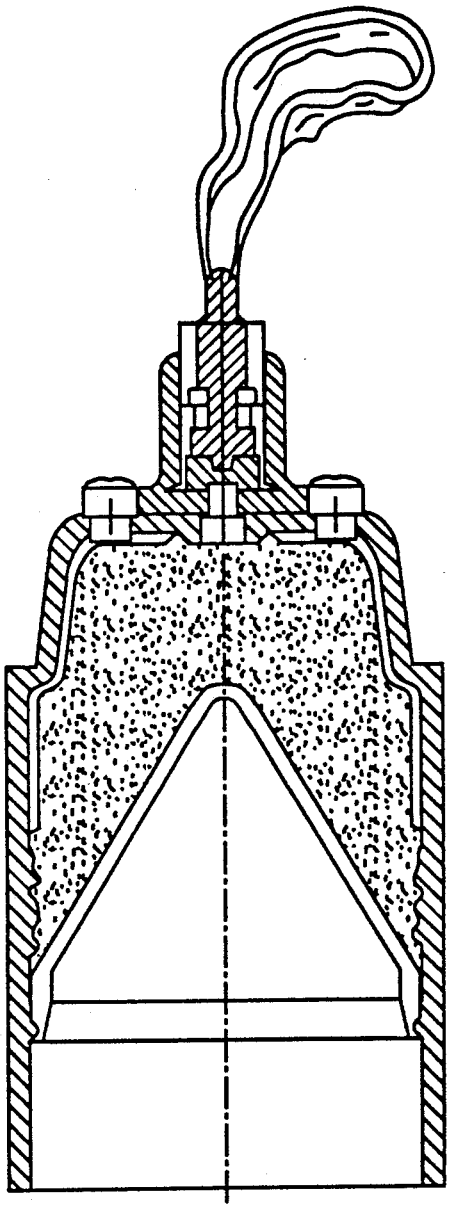
PRIOR ART FIG.4
FIG. 4 is a cross-sectional view of a prior art M42/M46 air-delivered submunition grenade employing a stab detonator.

It has not been possible to realistically simulate the effects of submunition fire in a tactical engagement simulation since even inert, sound-producing devices could become deadly if launched by artillery or dropped from a plane. The mass and velocity of such objects when they impact the target renders them very dangerous. The present invention, however, simulates the lethality of a submunition which has not detonated upon impact but remains "live." This has been a real problem in desert combat where the relative softness of sand can cushion the impact of an incoming submunition. FIG. 4 shows a cross-section of the M42/M46 grenade submunition which employs a stab detonator.

Such a device can fail to detonate if it impacts at any angle substantially less than 90° from the target.

Submunitions can be projected into areas controlled by the opposing force. Thus, while the opposing force may not anticipate a mine threat in their own territory, they must remain alert at all times for unexploded submunitions, particularly near typical submunition targets such as airports. Furthermore, many infantrymen are not familiar with the various types of submunitions because these weapons are typically deployed by other forces (i.e. artillery or aircraft). Many submunitions, such as the blue series of spherical bomblets shown in FIG. 2 are relatively small and can be concealed in tall grass or covered by sand. Subsequently, there is a need to incorporate unexploded submunition training devices into tactical engagement simulations so that soldiers may become aware of these hazards and develop strategies to combat them.

The present invention simulates the effects of an unexploded submunition without the danger involved in conventional submunition delivery. A referee locates a position for the training submunition in the training battle zone, pulls out a pin from an arming switch (note that a real submunition does not have such an arming pin and switch), and places the submunition down. The switch closes and allows voltage from a battery or some other type of power source to activate a first timer. This timer can be preset for any desired "time-out" corresponding to the time reasonably needed by a referee to position the training device and subsequently evacuate the immediate area surrounding the training device. Presently, a time-out of about 20 seconds is used. During this delay a capacitor in the firing circuit is charged. If left undisturbed, the grenade submunition will lay in this state for several days (i.e. until the charge dissipates). However, if the submunition is picked up or otherwise physically disturbed by one of the players, a motion switch senses the disturbance and sends a signal which can fire a flash bulb, indicating function. At the same time, or alternatively, an electronic buzzer is activated through a second timer which causes it to sound for a predetermined period of time. The audible signal, and flash if it is employed, indicate to the soldier and to an audio-equipped tactical engagement simulation system, that an unexploded submunition has been disturbed and that the soldier would be a casualty had the device been real. The length and duration of the audible signal are such that it can be distinguished from other battlefield noises at ranges corresponding to the lethality of a real submunition. The audible signal may also be modulated as described in copending patent application Ser. No. 07/983,952.

Figure 5:
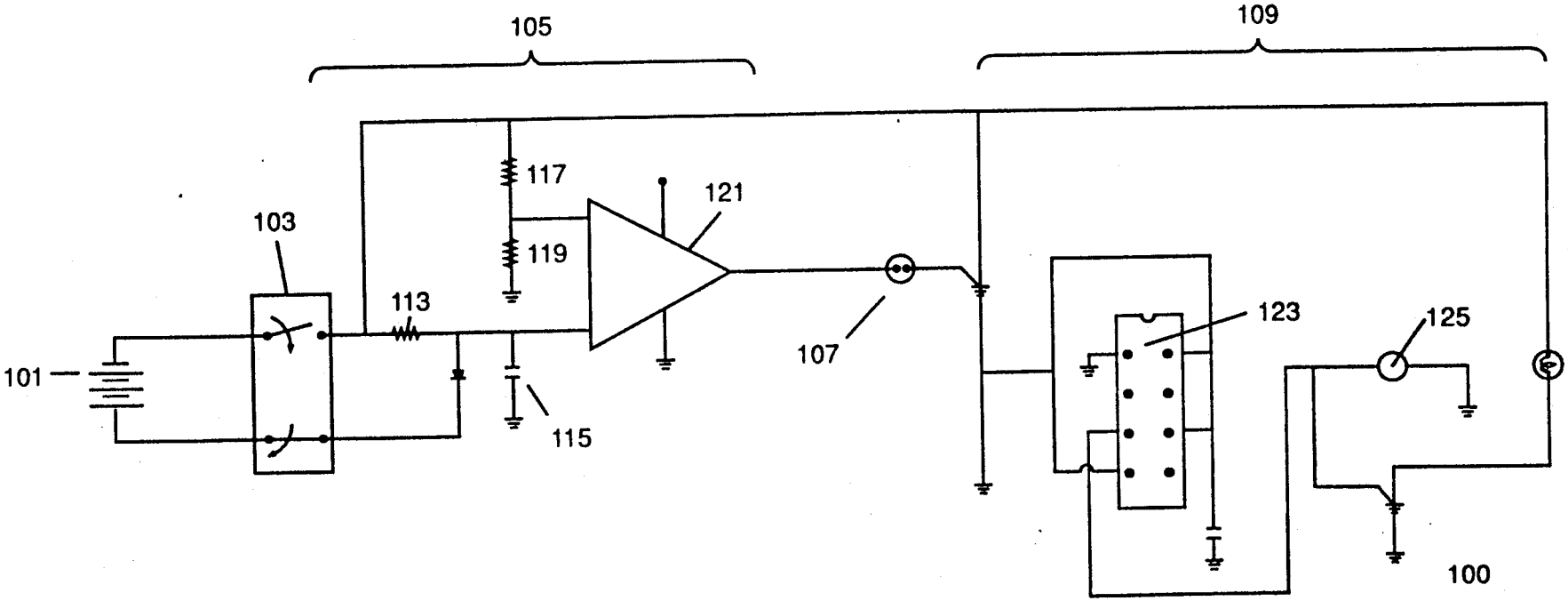
FIG. 5 is a circuit diagram for an acoustic training submunition according to the present invention.

FIG. 5 is an electrical schematic of the circuit 100 which is common to all the submunition training devices described herein. The general features of the circuit include a power source 101 which is typically a battery, the size of which depends on the submunition being simulated (e.g. cylindrical 6 V lithium for the M42/M46 and blue series spherical bomblet, and rectangular 9 V alkaline for the M118 trainer); an arming switch 103 which includes some type of pin or external control; a first timing circuit 105 for defining a time-out period during which the submunition is placed and armed; a motion sensing switch 107 which closes when disturbed; a sound generating circuit 109 and an optional flash bulb 111 to enhance the realism of the event.

When the pin is pulled from phone-type switch 103, capacitor 115 begins to charge. After about 20 seconds, capacitor 115 charges to about 0.75 Vcc (the voltage source 101), which is enough to trigger comparator 121 to go "high." The output signal of comparator 121 effectively renders the submunition training device "live." The charging time can be adjusted by changing the R-C time constant of a first circuit comprising a resistor 113 and capacitor 115 or the comparator trigger level related to the values of resistors 117 and 119, the voltage between which provides one input to the comparator 121. Of course, other timing means may be devised for achieving an appropriate "time-out" period, but this circuit is relatively straightforward, rugged and dependable.

Figure 9A:
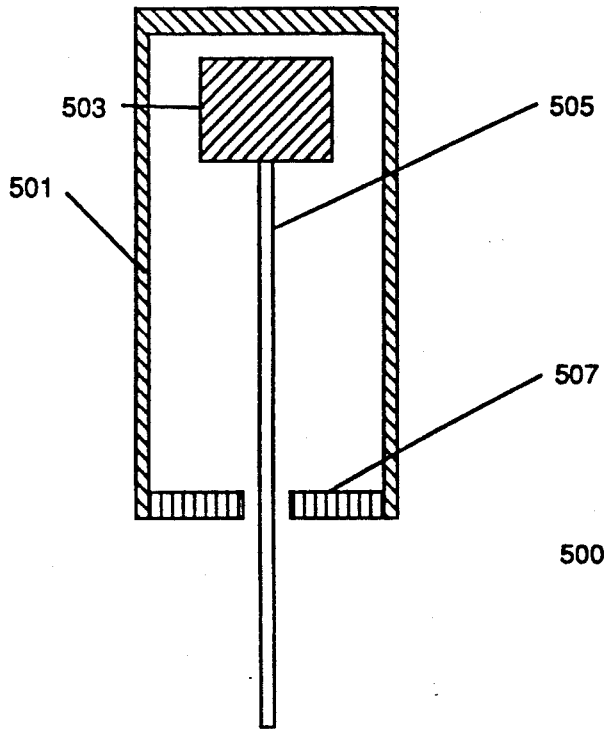
Figure 9B:
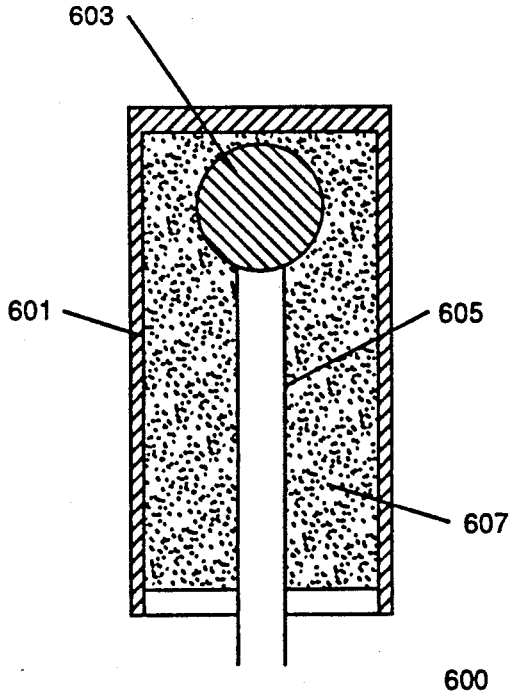

Once armed, any small movement or vibration will trigger inertia switch 107, which is either a mechanical motion switch 500 as illustrated in FIG. 8 or a multidirectional mercury switch 600 as shown in FIG. 9. A suitable switch for present purposes is the model 2008-4 mercury vibration/motion switch produced by Signal Systems International or Lavallette, N.J. The model 2008-4 is only 0.325" in diameter and 0.38" long, thus being easily packaged in a submunition-like housing along with other electrical and electro-mechanical components of the present invention. Triggering of such an inertia switch 107 supplies voltage to a second timer circuit 123 which drives the buzzer 125 and optional flashbulb 111. The frequency, duration and means for modulating the audible signal are discussed in copending patent application Ser. No. 07/983,952. Currently, MILES-compatible training submunitions emit a 70–80 dB signal at 3750 Hz for about 4 seconds. A pulse-modulation rate of 50–100 milliseconds may also be implemented where receiver circuitry is designed to detect modulated signals. The amplitude of the signal ensures an appropriate "kill radius" within which the training device will cause an audio-adapted tactical engagement system to indicate a casualty. The frequency and modulation scheme have been chosen to distinguish over ambient battlefield noises. The preferred flashbulb 111 is a common type camera flashbulb such as the Sylvania Blue Dot, although an LED or Xenon flash beacon would also suffice.

Figure 6:
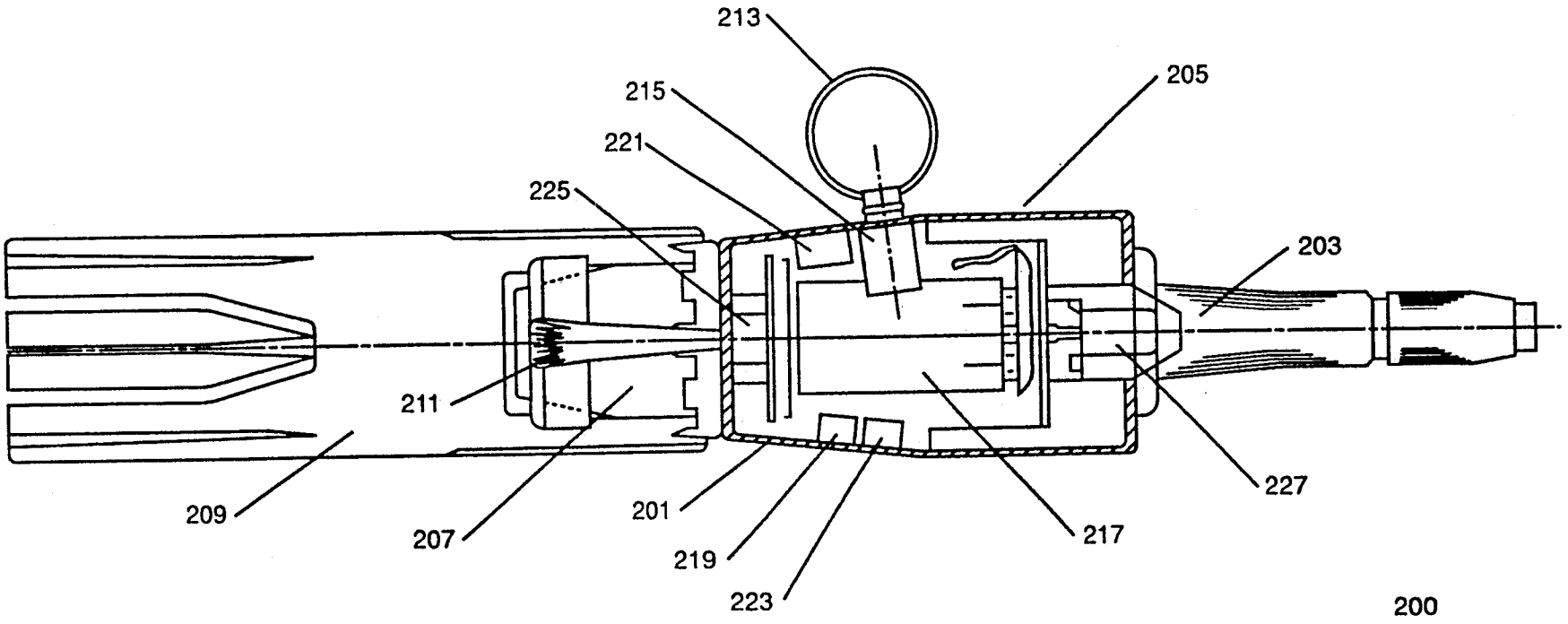
FIG. 6 is a cross-sectional view of the M118 Rockeye acoustic training device according to the present invention.
Figure 7B:
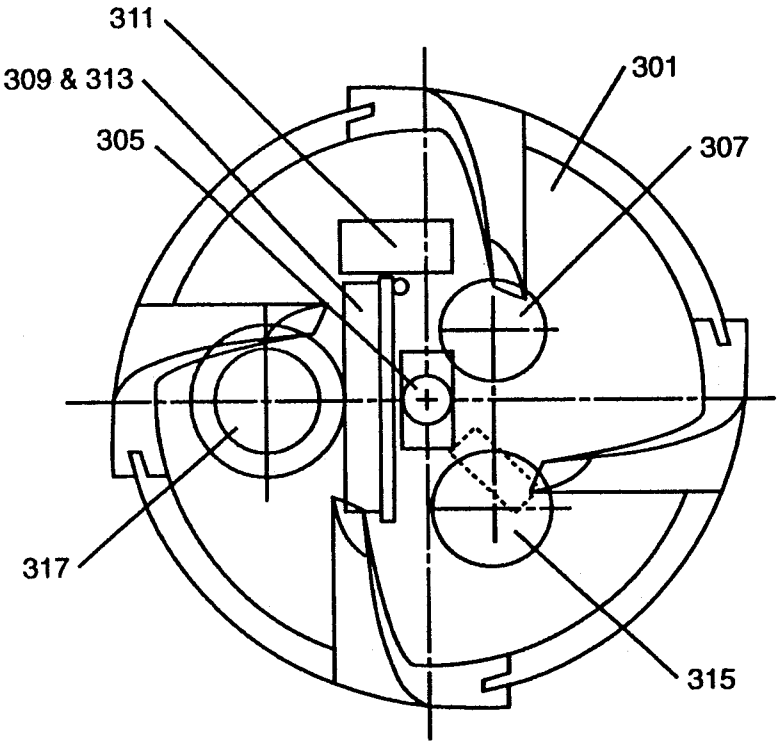
Figure 7A:
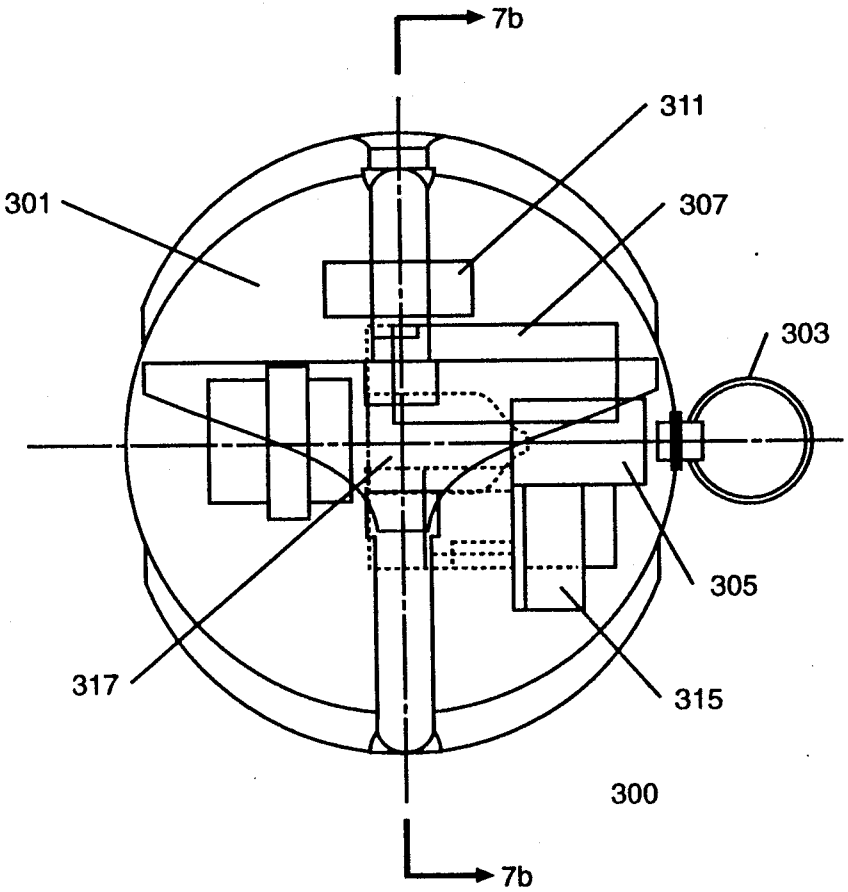

Referring now to FIG. 6, an M118 Rockeye training submunition 200 is shown in cross-section so that the arrangement of internal elements may be discerned. The housing is made up of two main components. These are a tubular casing 201 which is cup-like and typically aluminum, and a clear or translucent plastic cover 205 which threads onto the tubular casing to form a substantially cylindrical body. A nose cone 203 protrudes from the clear plastic cover, and may be integrally formed of plastic with an aluminum sheathing. At the rear of the tubular casing 201 a smaller housing 207 with an integral acoustic horn 211 protrudes rearward. A plurality of fins 209 extend from the rear housing 207 to accurately mimic the actual device.

Unlike the true M118 Rockeye submunition, however, the training device 200 is provided with an external ring and pull pin 213 which is inserted into an arming switch 215 affixed to the inside of the tubular casing 201. The arming switch 215 is a phone type switch with a nonintegral pin inserted between contacts. The transducer 225 is located just ahead of an opening in the base of the tubular casing 201 and the mouth of the acoustical horn 211 which is machined into the rear housing 207. A 9-V alkaline battery is suspended within the cylindrical body formed by the tubular casing 201 and plastic cover 205. A flashbulb 227 sits in front of the battery 217 so that when the plastic cover 205 is removed, both the flashbulb 227 and the battery 217 are accessible. The motion switch 221 is also affixed internally to the housing 201 so that it moves with the whole device. The tubular casing 201 also houses the delay circuit 219 which controls the "time-out" period during which a referee may place the submunition training device 200 and leave the area, and the timer circuit 223 which fires the flashbulb 227 and drives the transducer 225. Because the flashbulb 227 is located forward of the tubular casing 201 and within the plastic cover 205, the flash of light it creates is visible to those soldiers who inadvertently set-off the device.

Two cross-sectional views of a blue series spherical bomblet submunition trainer 300 are shown in FIGS. *7a* and *7b* respectively. The housing 301 of this training submunition is a hollow blue-tinted, translucent urethane sphere resembling in size and features the actual blue series of submunitions. It is preferably formed in two hemispherical pieces and joined by machine screws and threaded inserts (not shown). Like the M118 Rockeye training device 200, the blue series submunition training device 300 is provided with a pull ring and pin assembly 303 which is inserted between contacts in an arming switch 305. The blue series of submunition are smaller than the M118 Rockeye housing and thus require a smaller power source 307, such as a 6V lithium of the type commonly used in portable cameras.

The M42/M46 grenade submunition training device 400 also employs the smaller power source 411 which is located inside the lower half of a metallic tubular housing 401. Like the M118 Rockeye submunition training device 200, however, the upper half of the housing 401 can be formed from a translucent or clear plastic and threaded to the lower half. In such a configuration the flashbulb 421 is located in the upper half so that the flash is visible to troops. In addition to all the foregoing elements described in connection with the M118 Rockeye submunition training device 200 and the blue series submunition training device 300, the M42/M46 submunition training device 400 is also provided with a dummy fuze 405 and ribbon attachment 403 which mimic the actual M42/M46 for realism. The real M42/M46 submunition as shown in FIGS. 3 and 4 is provided with a ribbon which allows a pin to unscrew in flight. A spring then pushes the detonator into alignment with a shape charge. Impact at angles near 90° results in detonation of the real weapon.

While there has been described and illustrated specific embodiments of the invention, it will be obvious that various changes, modifications and additions can be made herein without departing from the field of the invention which should be limited only by the scope of the appended claims.

I claim:

1. An acoustic training device for simulating the effects of a submunition in a tactical engagement simulation system employing acoustic receivers, said training device comprising a housing which resembles a submunition, means for generating an audible signal of a particular frequency and duration, motion sensing means, means responsive to said motion sensing means for activating said signal generating means, a manually operated switch for arming said device, and timing means to delay activation of said motion sensing means once armed so that said device may be deployed without activating said signal generating means, wherein said timing means comprises an R-C circuit and comparator, said R-C circuit comprising a power source, a first resistor and a capacitor in series, said resistor and capacitor being in parallel with said power source and with a second and third resistor which form a voltage divider, a first voltage between said first resistor and capacitor and a second voltage between said second and third resistors being the inputs to said comparator which outputs a signal voltage when said capacitor charges to a predetermined voltage.

2. The invention of claim 1 wherein said motion sensing means comprises an inertial switch and the output of said comparator is routed through said switch so that said signal generating means cannot be activated in the absence of motion.

3. The invention of claim 2 wherein said signal generating means comprises a timer, and a buzzer responsive to the output of said timer, whereby an acoustic signal of a particular duration and frequency will be emitted when said device is armed and subsequently disturbed.

4. A method for simulating the lethality of unexploded submunitions in a tactical engagement simulation system equipped with acoustic receivers, said method comprising the steps of:

(a) transporting an acoustic training device to a battlefield location corresponding to a simulated submunition attack, wherein said training device comprises a housing which resembles a submunition, means for generating an audible signal of a particular frequency and duration, motion sensing means, means responsive to said motion sensing for activating said signal generating means, a manually operated switch for arming said device, and timing means to delay activation of said motion sensing means once armed;

(b) arming said device;

(c) placing said device in the battlefield; and (d) evacuating the immediate area surrounding the placed device within a period of time corresponding to said time delay so as to avoid premature activation of said signal generating means, whereby said device will thereafter generate an audible signal upon being physically disturbed and cause the tactical engagement simulation system to register a kill.

* * * * *